US009565978B2

(12) United States Patent
Hall

(10) Patent No.: US 9,565,978 B2
(45) Date of Patent: Feb. 14, 2017

(54) MULTIPLE DISPENSING ASSEMBLY

(71) Applicant: Dominick Hall, Sacramento, CA (US)

(72) Inventor: Dominick Hall, Sacramento, CA (US)

(73) Assignee: Dominick Hall, Sacramento, CA (US)

( * ) Notice: Subject to any disclaimer, the term of this patent is extended or adjusted under 35 U.S.C. 154(b) by 0 days.

(21) Appl. No.: 14/680,045

(22) Filed: Apr. 6, 2015

(65) Prior Publication Data

US 2015/0305576 A1 Oct. 29, 2015

Related U.S. Application Data

(60) Provisional application No. 61/976,397, filed on Apr. 7, 2014.

(51) Int. Cl.

| | |
|---|---|
| ***A47K 5/12*** | (2006.01) |
| ***B05B 11/00*** | (2006.01) |
| *B65D 83/68* | (2006.01) |
| *B65D 81/32* | (2006.01) |

(52) U.S. Cl.

CPC ..... *A47K 5/1211* (2013.01); *A47K 5/12* (2013.01); *B05B 11/30* (2013.01); *B05B 11/3084* (2013.01); *B05B 11/3059* (2013.01); *B65D 81/3288* (2013.01); *B65D 83/68* (2013.01)

(58) Field of Classification Search

CPC .. B05B 11/3059; B05B 11/3084; B05B 11/30; B65D 81/3288; B65D 83/68; A47K 5/1211; A47K 5/12

See application file for complete search history.

(56) References Cited

U.S. PATENT DOCUMENTS 3,084,871 A * 4/1963 Puglis ..... B65D 83/386 221/127
3,211,343 A * 10/1965 Silver ..... B65D 83/68 222/144.5
3,884,392 A * 5/1975 Hazard ..... B65D 47/305 222/153.14
4,595,127 A * 6/1986 Stoody ..... B05B 7/2421 222/135
4,819,832 A * 4/1989 Lawson ..... B05B 11/0005 222/153.13
4,826,048 A * 5/1989 Skorka ..... B67D 7/0205 222/135
4,972,973 A * 11/1990 Davis ..... B65D 81/3879 222/131

(Continued)

*Primary Examiner* — Frederick C Nicolas

(57) ABSTRACT

A multiple dispensing assembly provides a plurality of containers that contain and dispense a composition, such as a cosmetic gel. Each container contains a unique composition that dispenses separately from the other containers. The containers are arranged in a geometric configuration enabling adjacent attachment to form a unitary, uniform conglomeration. The containers are joined through a rail portion, comprising a male and female rail. The rail portion enables the containers to join in a substantially unitary and uniform conglomeration through a geometric configuration of the containers. The rail portion further enables each container to be independently interchanged through a sliding motion. An internal vacuum pump portion, having a floating floor, displaces the composition from a lower region to an upper region of the container. A dispensing portion includes a spout that moves between a recessed position and an operational position.

19 Claims, 5 Drawing Sheets

(56) References Cited

U.S. PATENT DOCUMENTS

| | | | | | |
|---|---|---|---|---|---|
| 4,982,877 | A * | 1/1991 | Burton | B67D 1/02 | 222/135 |
| 5,203,841 | A * | 4/1993 | Kitabayashi | B65D 47/2043 | 222/402.11 |
| 5,649,643 | A * | 7/1997 | Ridgeway | A47K 5/12 | 222/105 |
| 5,740,947 | A * | 4/1998 | Flaig | B65D 81/3288 | 220/23.4 |
| 5,746,353 | A * | 5/1998 | Cheok | A47F 1/035 | 222/132 |
| 6,464,107 | B1 * | 10/2002 | Brugger | B05B 11/3056 | 222/134 |
| 6,604,655 | B1 * | 8/2003 | Lee | B05B 11/3084 | 222/135 |
| 6,796,464 | B1 * | 9/2004 | Tung | B65D 47/305 | 222/402.13 |
| 6,968,982 | B1 * | 11/2005 | Burns | B65D 83/26 | 222/135 |
| 7,240,808 | B2 * | 7/2007 | Brugger | B05B 11/3084 | 222/135 |
| 2004/0149775 | A1 * | 8/2004 | Chen | A45D 34/00 | 222/135 |
| 2004/0238567 | A1 * | 12/2004 | Bloc | B05B 11/3084 | 222/135 |
| 2005/0150905 | A1 * | 7/2005 | van der Heijden | B05B 11/3084 | 222/135 |
| 2010/0044394 | A1 * | 2/2010 | Milian | B05B 11/3007 | 222/135 |
| 2011/0036867 | A1 * | 2/2011 | Flores | A47K 5/1202 | 222/144.5 |
| 2012/0031925 | A1 * | 2/2012 | Greenberg | B05B 11/3059 | 222/135 |

* cited by examiner

MULTIPLE DISPENSING ASSEMBLY

CROSS-REFERENCE TO RELATED APPLICATIONS

The present Utility patent application claims priority benefit of the U.S. provisional application for patent Ser. No. 61/976,397 entitled "JOINABLE PUMP BOTTLES" filed 2014 Apr. 7, under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

FIELD OF THE INVENTION

One or more embodiments of the invention generally relate to a multiple dispensing assembly. More particularly, the invention relates to a multiple dispensing assembly that provides a plurality of containers that are detachably joined in a uniform geometric configuration through a rail portion, with each container having a unique composition and independently dispensing the respective composition through a retractable spout.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that cosmetics are care and cleaning compositions that are generally used to enhance the appearance or odor of body parts. The composition can include mixtures of chemical compounds that are derived from natural sources or synthetic chemicals.

Typically, a pump can be used to dispense cosmetics, soaps, and compositions. The pump is configured to displace the composition by mechanical action that creates a vacuum. A cosmetic dispenser may be at type of pump that, when manipulated or triggered appropriately, yields the composition in the connected container. It can be manually operated by means of a pump-action spout.

Often, multiple different cosmetic compositions must be used simultaneously to achieve a desired result. This requires accessing multiple containers and pump mechanisms to access the desired cosmetic compositions.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A illustrates a front perspective view of an exemplary container, FIG. 1B illustrates a side perspective view of the container, and FIG. 1C illustrates a rear view of the container, in accordance with an embodiment of the present invention; FIG. 2A illustrates a side perspective view of an exemplary spout in a recessed position, and FIG. 2B illustrates a side perspective view of the spout in an operational position, in accordance with an embodiment of the present invention.

FIG. 3A illustrates a side perspective view of an exemplary spout in a removed/exploded views, and FIG. 3B illustrates an exploded view of various internal components thereof, in accordance with an embodiment of the present invention.

FIG. 3A illustrates a side perspective view of an exemplary spout in a removed/exploded views, and FIG. 3B illustrates an exploded view of various internal components thereof, in accordance with an embodiment of the present invention.

Figure 1A:
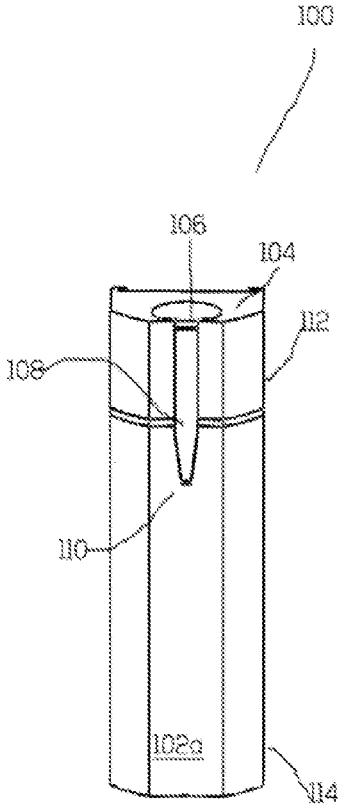
FIGS. 1A, 1B, and 1C illustrate perspective views of an exemplary multiple dispensing assembly, where

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, is well settle law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forward most point of the upper or outsole and the rearward most point of the upper or outsole.

Similarly, term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. §112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . " Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of."

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

The present invention will now be described in detail with reference to embodiments thereof as illustrated in the accompanying drawings.

There are various types of dispensing assemblies that may be provided by preferred embodiments of the present invention. In one embodiment of the present invention, a multiple dispensing assembly provides a plurality of containers that are detachably joined in a unique geometric configuration. The containers may be configured to contain and dispense a composition. Each container may contain a unique composition that dispenses separately from the other containers. The containers may be joined through a rail portion that enables formation of the geometric configuration; thereby forming a substantially unitary and uniform conglomeration.

In some embodiments, the containers may joined together in an adjacent arrangement through the rail portion. The rail portion forms an elongated surface on which each container slidably engages to form the conglomerate unitary assembly of containers. The rail portion enables each individual container to be interchanged with a new container that has a full quantity of the composition, or a different composition. This flexible interchangeability helps reduce waste of compositions since all of the containers do not have to be replaced when only one container requires changing.

The rail portion may include a male rail and a female rail that enable slidable attachment and detachment of individual containers and seamless integration into a unitary assembly. The rail portion may extend transversely across the plurality of containers. The containers may be disposed to align and detachably join along the length of the rail portion. The containers may slidably engage the rail portion to join together. This same sliding motion is required to detach the container from the terminus of the rails. In one embodiment, the containers may include a lip that rides the female rail.

In one exemplary embodiment, the containers slide onto the rail portion, and with locking grooves on the backside of each container, are locked into place. When removed, applying vertical pressure in opposing directions disengages the locking grooves, and the containers can be further slid until they completely disconnect.

This rail attachment mechanism allows separate storage and containment for each container, which maintains the integrity of each independent formulation and preserve interchangeability and preparation of depleted containers. Further, the geometric configuration of the containers forms a visual effect of a unitary assembly of containers. For example, the containers have a uniform height and width across the entirety of the assembly to form a visual effect of a unitary assembly. In some embodiments, each container may be shaped to contain the desired amount and type of composition. The containers may include a cavity, a lower region, and an upper region in which the composition resides.

The containers may further include a dispensing portion. Thus, the containers form a unitary conglomeration, with each container segregating a unique composition and dispensing the composition through a retractable dispensing portion. The dispensing portion may include a spout that is disposed in a depression in the container. The spout may selectively move between a recessed positon within the depression, and an extended operational position for enabling dispensing of the composition. When the spout is locked in the recessed position, the spout is less prone to inadvertent engagement, which may cause accidental dispensing. As a result, a cap to protectively cover the spout is generally not necessary.

In some embodiments, the dispensing portion may include an internal vacuum pump. The internal vacuum portion may be configured to enable displacement of the composition between the upper region and the lower region of the container. The internal vacuum utilizes airless pumping, and thus, does not require a tube to pass into the cavity of the container. In one exemplary embodiment, when the spout is depressed, the air and composition are sucked out of the cavity of the container and forced out of a nozzle on the spout.

In this embodiment, the dispensing portion may include an internal vacuum pump portion that sucks the composition in stages from a lower region to an upper region of the container. The internal vacuum pump portion may include a floating floor that moves up and down along the container. The floating floor may be configured to carry the composition to an upper region of the container for dispensing.

In some embodiments, the spout may be operable to dispense the composition through a biased spring release device comprising of a spring and a spout release button. The spout is disposed inside the depression in the container while recessed. In this position, the spout is not as easily accessible, and thus, does not easily dispense composition by accident. This negates the need for a protective cap on the spout. By depressing the spout release button, the spout moves to the operational positon for dispensing the composition.

The spout is operable to dispense through a biased spring release device comprising of a spring and a spout release button. In one embodiment, the dispensing portion may dispense the composition by sucking the composition from the cavity of the container and out through a nozzle. As the composition is dispensed, the floating floor carries the composition from the lower region to the upper region, and towards the spout.

In some embodiments, the dispensing portion may more efficiently dispense because the containers are fabricated from a rigid thermoplastic polymer, such as acrylonitrile butadiene styrene (ABS). The generally rigid structure of ABS may ensures a structurally firm architecture for the internal pumping components to create the vacuum based dispensing method.

Figure 1B:
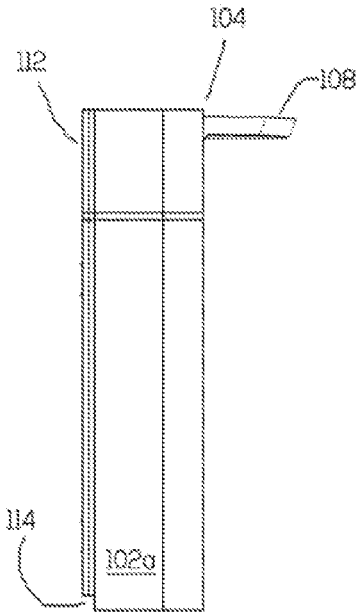
Figure 1C:
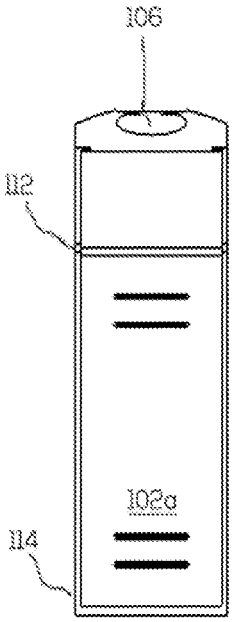

FIGS. 1A, 1B, and 1C illustrate perspective views of an exemplary multiple dispensing assembly, where FIG. 1A illustrates a front perspective view of an exemplary container, FIG. 1B illustrates a side perspective view of the container, and FIG. 1C illustrates a rear view of the container, in accordance with an embodiment of the present invention. In one aspect, a multiple dispensing assembly 100 provides a plurality of containers 102*a*, 102*b* detachably joined in a unique geometric configuration. The containers may be configured to contain and dispense a composition. Each container may contain a unique composition that dispenses separately from the other containers. The containers may have a geometric configuration that allows for them to be slidably joined in a substantially unitary and uniform conglomeration through a rail portion.

In some embodiments, the containers may joined together in an adjacent arrangement through the rail portion. The rail portion forms an elongated surface on which each container slidably engages to form the conglomerate unitary assembly of containers. The rail portion enables each individual container to be interchanged with a new container that has a full quantity of the composition, or a different composition. This flexible interchangeability helps reduce waste of compositions since all of the containers do not have to be replaced when only one container requires changing.

Through the rail portion, the containers may form the conglomerate unitary assembly of containers. The rail portion may enable the containers to join in a substantially unitary and uniform conglomeration. This uniform disposition is possible because the containers have a unique geometric configuration.

In one embodiment, the geometric configuration may be comprised of two straight side walls, and two angled walls leading to the front of one flat walled surface. The back of the containers consist of one flat wall, but with either the male or female rail connectors on the back wall. Once slid together along the rail portion to make the connection, the geometry is comprised of a rectangular form factor with the aforementioned angled walls at each end.

For example, the containers may have slightly tapered edges that align. This creates a decorative formation. The rail portion may also allow each container to be interchanged independently of the others. For example, the container slides along the length of the rail portion engaging or disengaging the terminus of the rail portion. Thus, the containers form a unitary conglomeration, with each container segregating a unique composition and dispensing the composition through a retractable dispensing portion. This flexible interchangeability helps reduce waste of compositions since all of the containers do not have to be replaced when only one container requires changing.

The rail portion may include a male rail and a female rail that enable slidable attachment and detachment of individual containers and seamless integration into a unitary assembly. The rail portion may extend transversely across the plurality of containers. The containers may be disposed to align and detachably join along the length of the rail portion. The containers may slidably engage the rail portion to detach the container from the terminus of the rails. In one embodiment, the containers may include a lip that rides the female rail.

In one embodiment, the rail portion may be up to 2 cm long. The containers join through the rail portion by facing back to back. A first container is elevated high enough to connect the bottommost part of the rail with topmost rail of the opposite container. Form this position, the elevated container may slide into the rail portion of the opposite container.

The mechanism of the rail portion allows separate storage and containment for each container, which maintains the integrity of each independent formulation and preserve interchangeability and preparation of depleted containers. Further, the geometric configuration of the containers forms a visual effect of a unitary assembly of containers. For example, the containers have a uniform height and width across the entirety of the assembly to form a visual effect of a unitary assembly.

In some embodiments, each container may be shaped to contain the desired amount and type of composition. The container may include a depression 106, a cavity, a lower region 112, and an upper region 114. The composition resides in the cavity. The composition may be displaced form the lower region to the upper region through a vacuum mechanism for dispensing. In some embodiments, the composition may include, without limitation, cosmetic gels, skin care, soap, and make up. As discussed above, each unique composition may be dispensed independently through its respective container.

The containers may further include a dispensing portion 104. Thus, the containers form a unitary conglomeration, with each container segregating a unique composition and dispensing the composition through a retractable dispensing portion. The dispensing portion may include a spout 108 that is disposed in the depression of the container. A nozzle 110 may extend from the spout, forming a terminus where the composition is ejected. The spout may selectively move between a recessed positon within the depression, and an extended operational position that extends out from the depression. The operational position enables a pumping motion that dispenses the composition. It is significant to note that when the spout is locked in the recessed position, the spout is less prone to inadvertent engagement, which may cause accidental dispensing. As a result, a cap to protectively cover the spout is generally not necessary.

In some embodiments, the dispensing portion may more efficiently dispense because the containers are fabricated from a rigid thermoplastic polymer, such as acrylonitrile butadiene styrene (ABS). The generally rigid structure of ABS may ensures a structurally firm architecture for the internal pumping components to create the vacuum based dispensing method. However, in other embodiments, any rigid polymer or metal may be used to construct the containers.

For example, without limitation, the material composition may include, Aluminum, Steel, Plastic #1—PET, PETE, Plastic #2—HDPE, Plastic #3—PVC, Vinyl, Plastic #5—PP, Plastic #6—PS and Plastic #7. Two other materials may include acrylonitrile styrene or styrene acrylonitrile (AS/SAN), and acrylonitrile butadiene styrene (ABS). Both are prolific and are used to make high quality, strong plastics.

In some embodiments, the dispensing portion may include an internal vacuum pump. The internal vacuum portion may be configured to enable displacement of the composition between the upper region and the lower region of the container. The internal vacuum utilizes airless pumping, and thus, does not require a tube to carry the composition. In one exemplary embodiment, when the spout is depressed, the air and composition are displaced from the container. When the spout is released, the composition is drawn out of a nozzle on the spout.

The internal vacuum pump portion may be configured to suck the composition in stages from a lower region to an upper region of the container. The internal vacuum pump portion may include a floating floor that moves up and down along the container in conjunction with the amount of composition remaining in the container. The floating floor may be configured to carry the composition to the upper region of the container for dispensing. The floating floor may form a seal with the edges of the housing cavity, so as to form a tight, efficient vacuum for sucking of the composition.

Figure 2A:
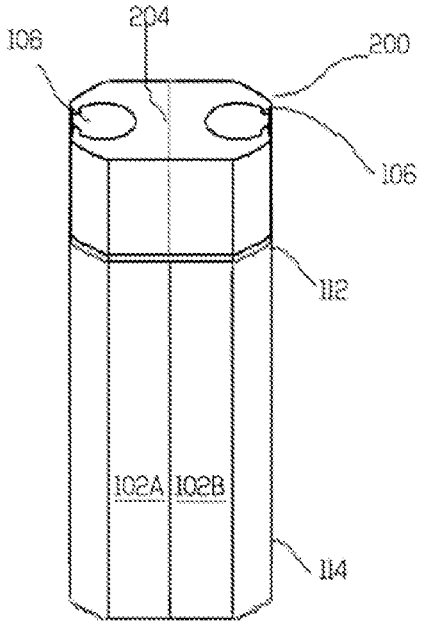
FIGS. 2A and 2B illustrate perspective views of an exemplary plurality of containers joined through an exemplary rail portion, where
Figure 2B:
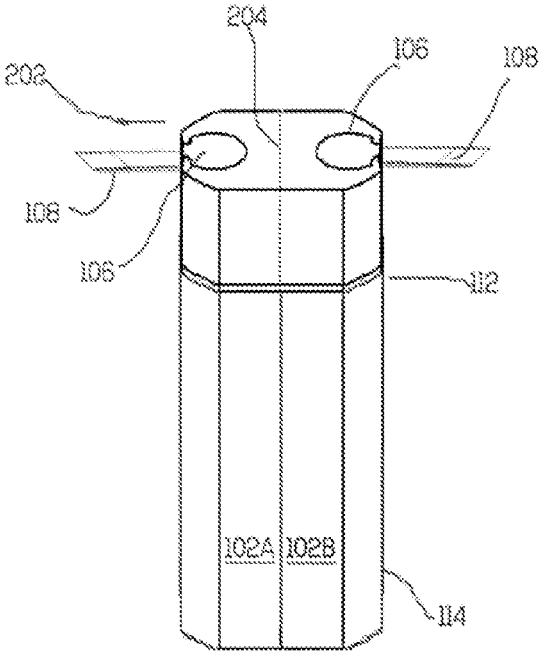

FIGS. 2A and 2B illustrate perspective views of an exemplary plurality of containers extending and retracting an exemplary spout, where FIG. 2A illustrates a side perspective view of the spout in a recessed position 200, and FIG. 2B illustrates a side perspective view of the spout in an operational position 202, in accordance with an embodiment of the present invention. In one aspect, the spout is operable to dispense the composition through a biased spring release device comprising of a spring and a spout release button.

As shown in FIG. 2A, the spout is disposed inside the depression in the container while recessed. In this position, the spout is not as easily accessible, and thus, does not easily dispense composition by accident. This negates the need for a protective cap on the spout. By depressing the spout release button, the spout moves to the operational positon, as shown in FIG. 2B. In one embodiment, the dispensing portion may dispense the composition by sucking the composition from the cavity of the container and forced out through a nozzle through an airless pumping mechanism. As the composition is dispensed, the floating floor carries the composition from the lower region to the upper region, and towards the spout.

In operation, the spout is lifted from the recessed position to the operational position through the spring release device. A button may be depressed, actuating the spring within the spring release device, which sucks the composition to the upper region of the container. The spout may then commence pumping to dispense the composition that is stored in the upper region chamber through the nozzle and sucks the composition into the upper region for the next dispensing. The floating floor moves remaining liquid up to be pumped into the upper region for subsequent dispensing. When dispensing is complete, the spout is returned to the recessed position to eliminate accidental dispensing.

In another possible embodiment of the internal pumping portion, a spring, a piston, and two check valves are used to dispense the composition. When the spout is depressed, the composition contained in the container with the spring is displaced through the spout because the lower check valve restricts further movement down. When the spout is released, the check valve in the spout closes off and the spring returns the piston, opening the lower check valve and drawing the composition up from the cavity of the container and out the nozzle. However, in either mechanism for the internal pumping portion, the basic principles of air suction within a closed container forces the composition out through the nozzle in the spout.

As discussed above, the containers may be joined through a rail portion 204. The rail portion forms an elongated member that supports the containers in a slidable arrangement. In this manner, each container slidably attaches and detaches from the rail portion. In one exemplary embodiment, the containers slide onto the rail portion, and with locking grooves on the backside of each container, are locked into place. When removed, applying vertical pressure in opposing directions disengages the locking grooves, and the containers can be further slid until they completely disconnect.

In one embodiment, the containers may be assembled on the rail portion to form a conglomerate unitary assembly of containers. The rail portion may enable the containers to join in a substantially unitary and uniform conglomeration. This uniform disposition is possible because the containers have a unique geometric configuration.

In one example of the unique geometric configuration of the containers, the containers may have slightly tapered edges that align. This creates a decorative formation. The rail portion may also allow each container to be interchanged independently of the others. For example, the container slides along the length of the rail portion to engage or disengage the terminus of the rail portion. This may help reduce waste since the complete assembly does not have to be replaced when one container requires changing.

In one alternative embodiment, the assembly forms a tapered contour with regressing sizes of containers. In another alternative embodiment, the composition is a petroleum or chemical product. In yet another alternative embodiment, the internal vacuum portion utilizes a bearing to help regulate the pumping motion of the spout.

What follows is some further description of at least some of the figures providing more details about the elements shown.

Figures 3A, 3B:
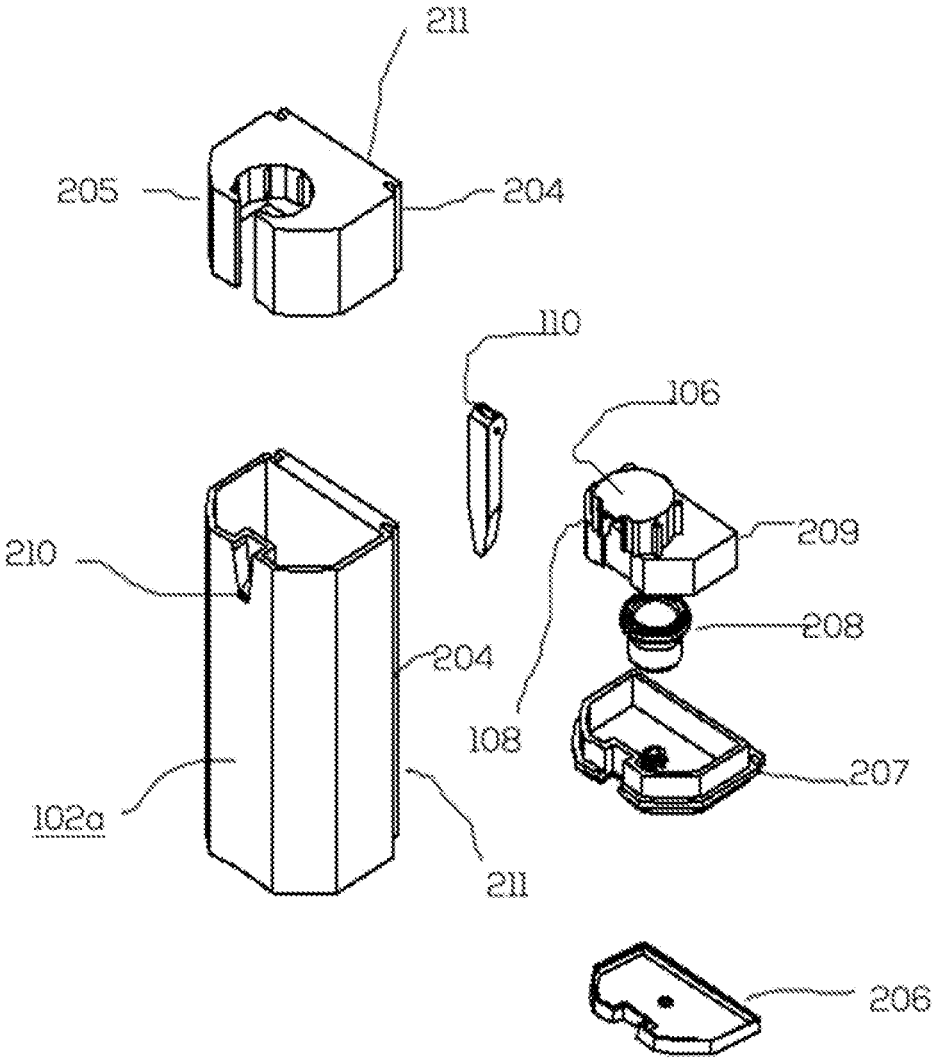
FIGS. 3A and 3B illustrate perspective views of another exemplary container, where

FIGS. 3A and 3B illustrate perspective views of another exemplary container, where FIG. 3A illustrates a side perspective view of an exemplary spout in a removed/exploded views, and FIG. 3B illustrates an exploded view of various internal components thereof, in accordance with an embodiment of the present invention.

Figures 4A, 4B:
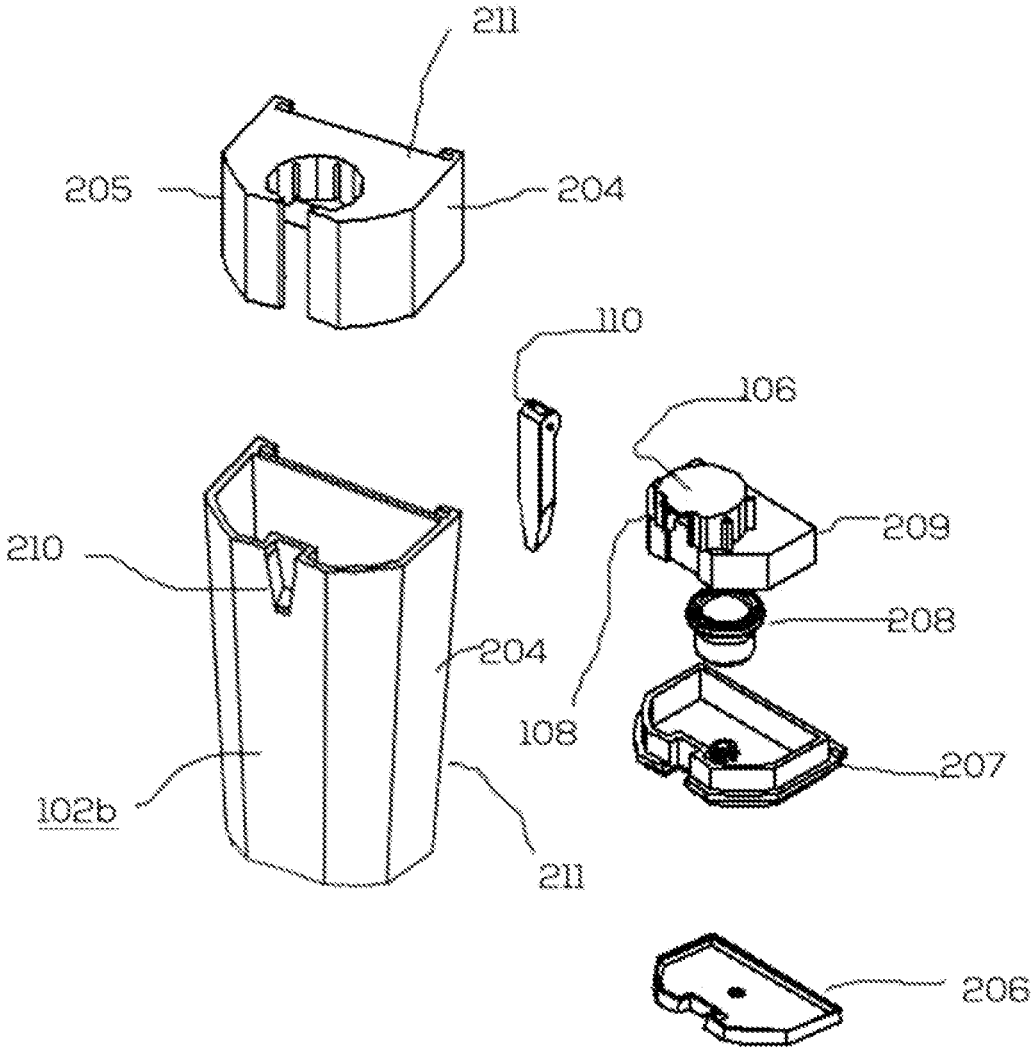
FIGS. 4A and 4B illustrate perspective views of another exemplary container, where

FIGS. 4A and 4B illustrate perspective views of another exemplary container, where FIG. 3A illustrates a side perspective view of an exemplary spout in a removed/exploded views, and FIG. 3B illustrates an exploded view of various internal components thereof, in accordance with an embodiment of the present invention.

Figure 5A:
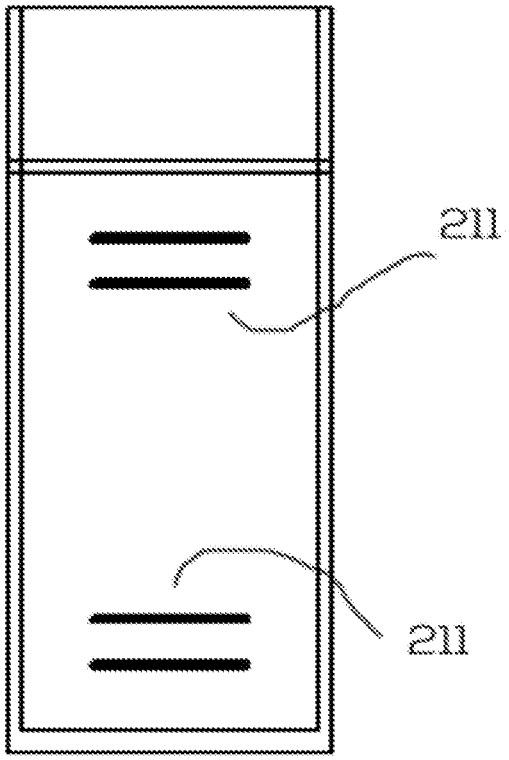
FIG. 5A illustrates a top view of an exemplary container having Bottle Locking Grooves, in accordance with an embodiment of the present invention.

FIG. 5A illustrates a top view of an exemplary container having Bottle Locking Grooves, in accordance with an embodiment of the present invention.

What follows are more itemized, element by element, details regarding FIG. 3A

102*a*—The Bottle Body. The Bottle body is the main containment source for liquid formulations kept within the bottle body cavity.

204—Male or Female Bottle Railing. Male or Female Bottle Railing is used to connect the bottles into one form factor. Male or Female Railing is Featured on both the Bottle Body and Bottle Cap.

205—Bottle Cap. Bottle cap which houses all of the internal pumping components, featuring a horizontal cutout to allow nozzle extending/recessing, and access to depress button all the way down without users finger being blocked by cap material.

211—Bottle Locking Grooves. Grooves which allow bottles to connect and remain in the connected position without accidental disengagement. Grooves interlock; ensuring bottles will not slide apart during usage or transport.

10—Anti-Dispense Bottle Lip. A recessed shelf/lip where the nozzle tip rests when in the recessed position. This shelf/lip keeps the liquid formulation from unintentionally being dispensed in the case of accidental depression of dispensing button.

What follows are more itemized, element by element, details regarding FIG. 3B

106—Top Button. The Top Button is a part of the Top Button Assembly described in #209.

108—The Spout. The Spout is a part of the Top Button Assembly described in #209.

206—Floating Floor. The floating floor gets vacuumed upwards when button/spring reservoir/bottle cavity top combination is actuated. The liquid formulation gets pulled up through the bottle cavity top by the floating floor, allowing for complete liquid dispensing.

207—Bottle Cavity Top. The Bottle Cavity Top provides an airtight seal between the bottle walls above the liquid storage cavity of the bottle. The Bottle Cavity Top features a lip around the geometry of the Bottle Cavity Top in order to keep it from falling inside the bottle liquid cavity. The Bottle Cavity Top also serves as the pumping platform for the Spring-reservoir/Top Button assembly.

208—Spring-Reservoir. The Spring-Reservoir creates a spring motion between the Bottle Cavity Top and the Top Button Assembly. It Allows the Top Button Assembly to be fully depressed, forcing air through the Bottle Cavity Top and into the bottle liquid cavity. This air is forced through an escape hole on the bottom of the bottle, allowing air to be sucked back in, pulling the Floating floor up with the liquid contained in the bottle cavity as the Spring-Reservoir returns to position. This process draws the liquid formulation up through the Bottle Cavity Top and into the Spring-Reservoir. Upon the next Top Button Assembly press, liquid contained in the Spring-Reservoir is expelled through the Spout/Nozzle Assembly, and new liquid is replaced in the Spring-Reservoir during the aforementioned process.

209—Top Button Assembly. The Top Button Assembly is comprised of a top platform housing with a recessed groove where the Spring-Reservoir securely rests. This housing is connected to a Top Button which is depressed to begin the liquid dispensing process. On the front side of this button resides a spout and hinge housing for the Nozzle.

110—Nozzle. When in the extended position, the Nozzle delivers the liquid formulation once the Top button is depressed to actuate the dispensing process. When in the recessed position, the Nozzle Acts as an anti-dispensing device when the Top Button Assembly is accidentally depressed. The Nozzle strikes against the Bottle Shelf/Lip recess to disallow accidental dispensing.

What follows are more itemized, element by element, details regarding FIG. 3B

106—Top Button. The Top Button is a part of the Top Button Assembly described in #209.

108—The Spout. The Spout is a part of the Top Button Assembly described in #209.

206—Floating Floor. The floating floor gets vacuumed upwards when button/spring reservoir/bottle cavity top combination is actuated. The liquid formulation gets pulled up through the bottle cavity top by the floating floor, allowing for complete liquid dispensing.

207—Bottle Cavity Top. The Bottle Cavity Top provides an airtight seal between the bottle walls above the liquid storage cavity of the bottle. The Bottle Cavity Top features a lip around the geometry of the Bottle Cavity Top in order to keep it from falling inside the bottle liquid cavity. The Bottle Cavity Top also serves as the pumping platform for the Spring-reservoir/Top Button assembly.

208—Spring-Reservoir. The Spring-Reservoir creates a spring motion between the Bottle Cavity Top and the Top Button Assembly. It Allows the Top Button Assembly to be fully depressed, forcing air through the Bottle Cavity Top and into the bottle liquid cavity. This air is forced through an escape hole on the bottom of the bottle, allowing air to be sucked back in, pulling the Floating floor up with the liquid contained in the bottle cavity as the Spring-Reservoir returns to position. This process draws the liquid formulation up through the Bottle Cavity Top and into the Spring-Reservoir. Upon the next Top Button Assembly press, liquid contained in the Spring-Reservoir is expelled through the Spout/Nozzle Assembly, and new liquid is replaced in the Spring-Reservoir during the aforementioned process.

209—Top Button Assembly. The Top Button Assembly is comprised of a top platform housing with a recessed groove where the Spring-Reservoir securely rests. This housing is connected to a Top Button which is depressed to begin the liquid dispensing process. On the front side of this button resides a spout and hinge housing for the Nozzle.

110—Nozzle. When in the extended position, the Nozzle delivers the liquid formulation once the Top button is depressed to actuate the dispensing process. When in the recessed position, the Nozzle Acts as an anti-dispensing device when the Top Button Assembly is accidentally depressed. The Nozzle strikes against the Bottle Shelf/Lip recess to disallow accidental dispensing.

What follows are more itemized, element by element, details regarding FIG. 5A

211-211—Bottle Locking Grooves. Grooves which allow bottles to connect and remain in the connected position without accidental disengagement. Grooves interlock, ensuring bottles will not slide apart during usage or transport.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC §112 (6). Applicant(s) note that all the identified documents above which are incorporated by reference to satisfy 35 USC §112 (6) necessarily have a filing and/or publication date prior to that of the instant application, and thus are valid prior documents to incorporated by reference in the instant application.

Having fully described at least one embodiment of the present invention, other equivalent or alternative methods of implementing a plurality of containers that detachably join through a rail mechanism to pump composition through a recessed spout that uses an internal vacuum pump according to the present invention will be apparent to those skilled in the art. Various aspects of the invention have been described above by way of illustration, and the specific embodiments disclosed are not intended to limit the invention to the particular forms disclosed. The particular implementation of the a plurality of containers that detachably join through a rail mechanism to pump composition through a recessed spout that uses an internal vacuum pump may vary depending upon the particular context or application. By way of example, and not limitation, the a plurality of containers that detachably join through a rail mechanism to pump composition through a recessed spout that uses an internal vacuum pump described in the foregoing were principally directed to a plurality of containers having a composition that detachably join into a unitary assembly through a railings, and use an internal vacuum pup to dispense composition through a recessed spout that remains recessed when not in operation implementations; however, similar techniques may instead be applied to a pumping mechanism for foods, petroleum products, and chemicals, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An assembly comprising:

a plurality of containers, said plurality of containers comprising a depression, a cavity, an upper region, and a lower region;

a rail portion, said rail portion being configured to enable said plurality of containers to join in a substantially unitary and uniform conglomeration, said rail portion further being configured to enable each container to be independently interchanged;

an internal vacuum pump portion, said internal vacuum portion being configured to enable displacement between said upper region and said lower region of said plurality of containers; and a dispensing portion, said dispensing portion being configured to enable dispensing from said plurality of containers, said dispensing portion comprising a spout, said spout being configured to move between a recessed position that is disposed at least partially inside said depression of said plurality of containers, and an operational position that is disposed to be extended out from said depression of said plurality of containers.

2. The assembly of claim 1, wherein said plurality of containers are configured to at least partially contain a composition.

3. The assembly of claim 2, in which said composition comprises a cosmetic gel, a soap, a skin care cream, and a cleaning solution.

4. The assembly of claim 3, wherein said substantially unitary and uniform conglomeration of said plurality of containers is formed from a geometric composition.

5. The assembly of claim 4, wherein each of said plurality of containers is substantially rectangular.

6. The assembly of claim 5, in which said plurality of containers comprises two adjacent containers.

7. The assembly of claim 6, wherein said plurality of containers is fabricated from a rigid polymer.

8. The assembly of claim 7, in which said rigid polymer is acrylonitrile butadiene styrene.

9. The assembly of claim 8, in which rail portion comprises a male rail and a female rail.

10. The assembly of claim 9, wherein said plurality of containers is configured to engage and disengage said rail portion through a sliding motion.

11. The assembly of claim 10, wherein said sliding motion is operable on the male rail and the female rail.

12. The assembly of claim 11, in which said internal vacuum portion comprises a floating floor.

13. The assembly of claim 12, wherein said internal vacuum portion is operable as an airless pump.

14. The assembly of claim 13, wherein said floating floor is configured to form a seal with the perimeter of the plurality of containers.

15. The assembly of claim 14, wherein said floating floor forms a shape substantially the same as the cross section of the plurality of containers.

16. The assembly of claim 15, wherein said floating floor is configured to move from said lower region to said upper region.

17. The assembly of claim 16, in which said assembly further includes a nozzle.

18. The assembly of claim 17, wherein said nozzle is disposed to join with said spout, said nozzle forming a terminus for said spout.

19. An assembly consisting of:

a plurality of containers, said plurality of containers comprising a depression, a cavity, an upper region, and a lower region, said plurality of containers being fabricated from acrylonitrile butadiene styrene;

a rail portion, said rail portion comprising a male rail and a female rail, said rail portion being configured to enable said plurality of containers to join in a substantially unitary and uniform conglomeration through a geometric configuration, said rail portion further being configured to enable each container to be independently interchanged;

an internal vacuum pump portion, said internal vacuum portion comprising a floating floor, said internal vacuum portion being configured to enable displacement between said upper region and said lower region of said plurality of containers;

a dispensing portion, said dispensing portion being configured to enable dispensing from said plurality of containers, said dispensing portion comprising a spout, said spout being configured to move between a recessed position that is disposed at least partially inside said depression of said plurality of containers, and an operational position that is disposed to be extended out from said depression of said plurality of containers; and a nozzle, said nozzle is disposed to join with said spout, said nozzle forming a terminus for said spout.

* * * * *